US006535125B2

(12) United States Patent
Trivett

(10) Patent No.: US 6,535,125 B2
(45) Date of Patent: Mar. 18, 2003

(54) REMOTE CONTROL LOCATOR SYSTEM

(76) Inventor: Sam W. Trivett, P.O. Box 4280, Deland, FL (US) 32720

( * ) Notice: Subject to any disclaimer, the term of this patent is extended or adjusted under 35 U.S.C. 154(b) by 0 days.

(21) Appl. No.: 09/933,161

(22) Filed: Aug. 21, 2001

(65) Prior Publication Data

US 2002/0024449 A1 Feb. 28, 2002

Related U.S. Application Data

(60) Provisional application No. 60/226,935, filed on Aug. 22, 2000.

(51) Int. Cl.[7] ..... G08B 1/08

(52) U.S. Cl. ..... 340/539; 340/573.2; 455/575

(58) Field of Search ..... 340/539, 573.2, 340/686.6, 331, 329, 311.1; 345/98; 455/575

(56) References Cited

U.S. PATENT DOCUMENTS

| | | | | |
|---|---|---|---|---|
| 4,507,653 | A | 3/1985 | Bayer | 340/539 |
| 4,799,062 | A | 1/1989 | Sanderford, Jr. et al. | 342/450 |
| 4,961,575 | A | 10/1990 | Perry | 273/460 |
| 5,204,657 | A | 4/1993 | Prosser et al. | 340/571 |
| 5,214,410 | A | 5/1993 | Verster | 340/505 |
| 5,223,844 | A | 6/1993 | Mansell et al. | 342/357.07 |
| 5,289,163 | A | 2/1994 | Perez et al. | 340/539 |
| 5,294,915 | A | 3/1994 | Owen | 340/539 |
| 5,485,163 | A | 1/1996 | Singer et al. | 342/457 |
| 5,594,425 | A | 1/1997 | Ladner et al. | 340/825.49 |
| 5,629,677 | A | 5/1997 | Staino, Jr. | 340/568.1 |
| 5,638,050 | A | 6/1997 | Sacca et al. | 340/571 |
| 5,648,757 | A | 7/1997 | Vernace et al. | 340/539 |
| 5,652,570 | A | 7/1997 | Lepkofker | 340/573.4 |
| 5,673,023 | A | 9/1997 | Smith | 340/571 |
| 5,677,675 | A | 10/1997 | Taylor et al. | 340/571 |
| 5,680,105 | A | 10/1997 | Hedrick | 340/571 |
| 5,686,891 | A | 11/1997 | Sacca et al. | 340/571 |
| 5,705,997 | A | 1/1998 | Park | 340/825.49 |
| 5,790,021 | A | 8/1998 | Mickel et al. | 340/539 |
| 5,796,334 | A | 8/1998 | Chen et al. | 340/539 |
| 5,812,056 | A | 9/1998 | Law | 340/539 |
| 5,859,585 | A | 1/1999 | Fleming | 340/539 |
| 5,926,090 | A | 7/1999 | Taylor et al. | 340/568.1 |
| 5,939,981 | A | 8/1999 | Renney | 340/539 |
| 5,942,969 | A | 8/1999 | Wicks | 340/286.02 |
| 5,945,918 | A | 8/1999 | McGonigal et al. | 340/825.36 |
| 5,949,328 | A | 9/1999 | Latty | 340/326 |
| 5,955,952 | A | 9/1999 | Bergman et al. | 340/573.1 |
| 6,011,487 | A | 1/2000 | Plocher | 340/825.49 |
| 6,069,557 | A | 5/2000 | Anglin, Jr. et al. | 340/321 |
| 6,133,832 | A | 10/2000 | Winder et al. | 340/572.1 |
| 6,147,602 | A | 11/2000 | Bender | 340/568.1 |
| 6,150,921 | A | 11/2000 | Werb et al. | 340/10.1 |
| 6,166,652 | A | 12/2000 | Benvenuti | 340/825.49 |
| 6,184,789 | B1 | 2/2001 | Richley et al. | 340/571 |
| 6,225,901 | B1 | 5/2001 | Kail, IV | 340/539 |
| 6,297,737 | B1 | 10/2001 | Irvin | 340/571 |
| 6,304,183 | B1 | 10/2001 | Causey | 340/572.1 |
| 6,317,049 | B1 | 11/2001 | Toubia et al. | 340/573.4 |
| 6,366,202 | B1 * | 4/2002 | Rosenthal | 340/539 |

* cited by examiner

*Primary Examiner*—Daryl Pope
(74) *Attorney, Agent, or Firm*—Foley & Lardner

(57) ABSTRACT

A remote control locator system that can be retro-fitted to any existing remote control device in a straightforward manner. The remote control locator system comprises a sending unit and a receiving unit. The sending unit includes a transmitter residing in a sending unit housing and an activation mechanism coupled to the transmitter to send a locator signal when the activation mechanism is activated by a user. The receiving unit includes a receiver residing in a receiving unit housing to receive the locator signal and to emit an audible sound when the receiver receives the locator signal.

18 Claims, 4 Drawing Sheets

REMOTE CONTROL LOCATOR SYSTEM

This application claims benefit of priority from Provisional Application Serial No. 60/226,935, filed on Aug. 22, 2000, entitled "REMOTE CONTROL LOCATOR SYSTEM, " incorporated by reference in its entirety herein.

BACKGROUND OF THE INVENTION

The present invention is directed to a locator unit. In particular, the present invention is directed to a locator unit for remote control devices. Lost remote control units for consumer electronic devices are a common occurrence. While some newer remote controls are fitted with a "finder" feature, some older remote control models do not have such a feature.

SUMMARY OF THE INVENTION

According to one embodiment of the present invention, a remote control locator system to locate a household remote control device comprises a sending unit and a receiving unit. The sending unit includes a transmitter residing in a sending unit housing and an activation mechanism coupled to the transmitter to send a locator signal when the activation mechanism is activated by a user. The receiving unit includes a receiver residing in a receiving unit housing to receive the locator signal and to emit an audible sound when the receiver receives the locator signal.

According to another aspect of this embodiment, the receiving unit further comprises a multi-position switch located in the receiver unit housing and coupled to a processor chip located in the receiver unit housing. Thus, when the multi-position switch is placed in a first position, the speaker emits a preprogrammed audible sound when the receiver receives the locator signal. When the multi-position switch is placed in a second position, the speaker emits an audible sound corresponding to a personalized message recorded by a user when the receiver receives locator signal. A third position of the multi-position switch corresponds to a position which allows a user to record the personalized message through a microphone also housed in the receiver unit housing.

According to an alternative embodiment of the present invention, a remote control locator system to locate a household remote control device comprises a sending unit and a receiving unit. The sending unit includes an antenna residing in a sending unit housing and an encoder-type application specific integrated circuit (ASIC) to send a locator signal when the ASIC is activated by a user. The receiving unit includes a decoder-type ASIC and an antenna to receive the locator signal. The receiver unit further includes a sound integrated circuit (IC) to emit an audible sound when the antenna receiver receives the locator signal. The decoder-type ASIC, antenna, and sound IC are all housed in a receiving unit housing.

According to another aspect of this embodiment, the receiving unit further comprises a multi-position switch located in the receiver unit housing and coupled to a processor chip located in the receiver unit housing. Thus, when the multi-position switch is placed in a first position, the speaker emits a preprogrammed audible sound when the receiver receives the transmitted locator signal. When the multi-position switch is placed in a second position, the speaker emits an audible sound corresponding to a personalized message recorded by a user when the receiver receives the transmitted locator signal. A third position of the multi-position switch corresponds to a position which allows a user to record the personalized message through a microphone also housed in the receiver unit housing.

Further features and advantages of the invention, as well as the structure and operation of various embodiments of the invention, are described in detail below with reference to the accompanying drawings.

BRIEF DESCRIPTION OF THE DRAWINGS

The accompanying drawings, which are incorporated herein and form part of the specification, illustrate, but do not limit, the present invention and, together with the description, further serve to explain the principles of the invention and to enable a person skilled in the pertinent art to make and use the invention.

DETAILED DESCRIPTION OF THE INVENTION

Using a remote control locator system consistent with the present invention, it is possible to find a remote control device within the immediate location of the device it controls, normally within a house, a room or within about 50–75 feet. The remote control devices include, but are not limited to, a hand-held remote control for a television, VCR, cable TV box, or personal satellite system, an electronic key-chain used to remotely open car doors and activate car alarm systems, or other common household items susceptible to being misplaced (such as cellular phones, eyeglass/sunglass cases, dog collars, moneyclips, and wallets). The frequency of the remote control locator system is capable of penetrating walls, cabinets, drawers or furniture to locate a misplaced remote control unit.

Figure 1:
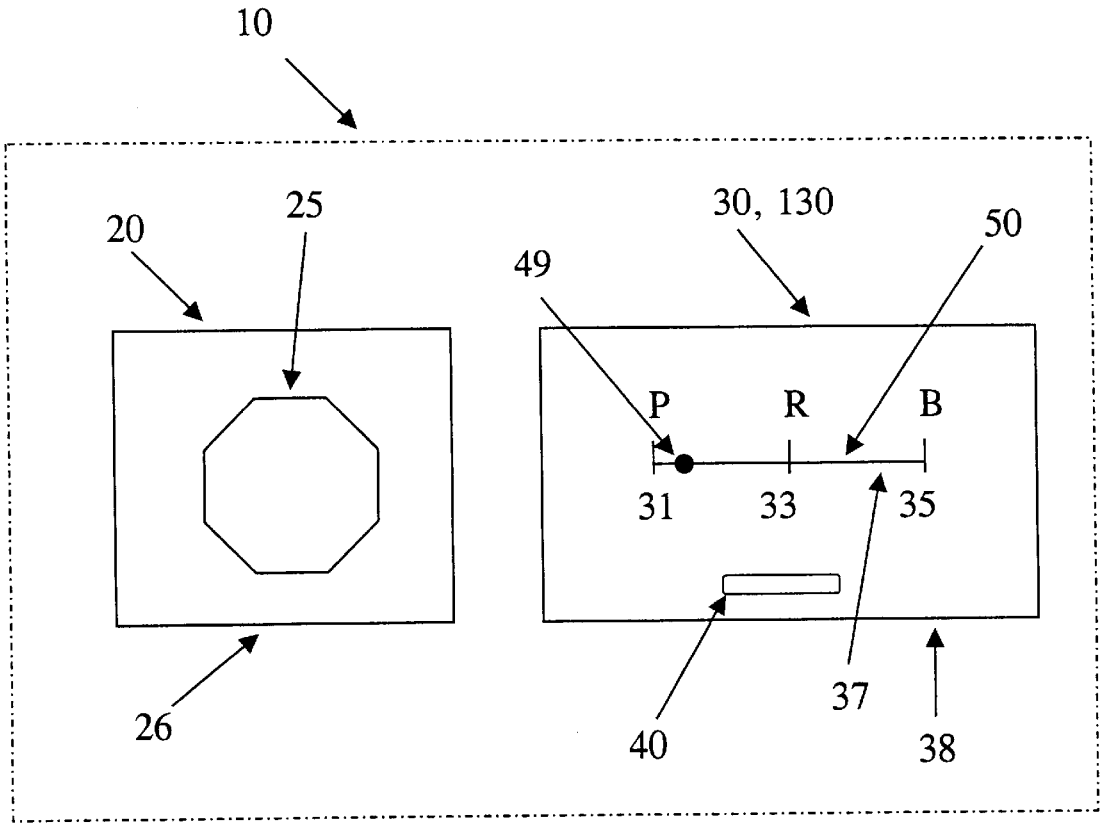
FIG. 1 is a schematic diagram of a remote control locator system according to one embodiment of the present invention.

A remote control locator system according to a first embodiment of the present invention is shown in FIG. 1. The locator system 10 comprises a sending unit 20 and a receiving unit 30. The receiving unit 30 (or retrofit beacon) is attachable to a conventional remote control unit (not shown). The sending unit 20 is a corresponding signaling device designed to activate the receiving unit 30.

Sending unit 20 comprises a coded signal transmitter 28 (shown in FIG. 2) that is enclosed in a housing 26 manufactured from a thin plastic material or the like. The housing can be rectangular or circular in shape, and is preferably thin, with a thickness of about ½" or less. Preferably, the housing 26 has a black matte finish to camouflage itself against most other typical consumer electronic devices, such as VCRs, TVs, cable TV receivers, and personal satellite system receivers. Sending unit 20 further comprises a triggering mechanism, such as a button 25, mounted through the top of the plastic housing 26 that triggers the transmitter 28 (shown in FIG. 2). The button 25 preferably has a shallow range of motion to facilitate ease of use. The button 25 can have rounded edges to maximize proper ergonomic conditions. The button can also be recessed to avoid accidental triggering. Other triggering mechanisms will be apparent to one of ordinary skill in the art given the present description.

Figure 2:
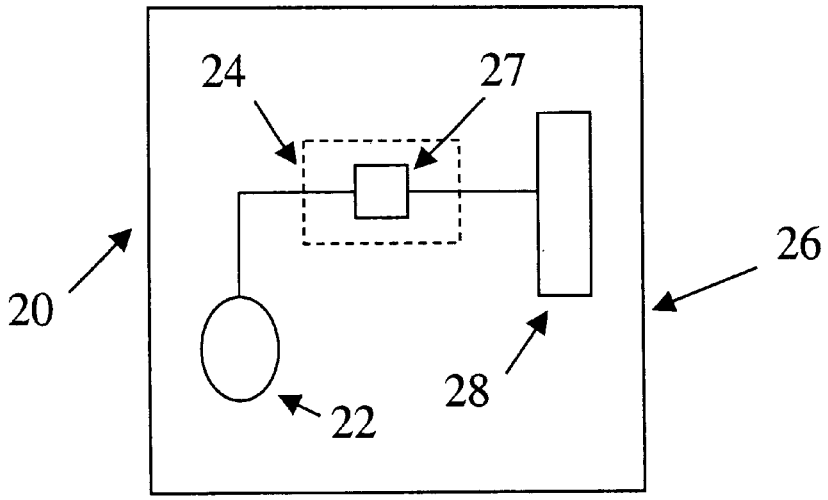
FIG. 2 is a schematic diagram of a sending unit of a remote control locator system according to another embodiment of the present invention.

The sending unit 20 is shown in further detail in FIG. 2. Sending unit 20 is designed to emit a preprogrammed or randomly chosen coded locator signal. The frequency of the locator signal can be a low, high, ultra high frequency, or radio frequency signal. Preferably, the frequency is selected so as to not interfere with other transmissions and to comply with all applicable FCC regulations on transmitters and interference. For example, transmitter 28 can be a conventional RF transmitter, which can include a commercially available ASIC from many electronic vendors, such as Princeton Technologies, Abacom Technologies, or Gateway Electronics. An exemplary ASIC is the Princeton Technologies PT 2622 transmitter/encoder ASIC. Other types of transmitter/encoders can also be used as would be apparent to one of ordinary skill in the art given the present description.

The button 25 is coupled to a switch 27 (either self-contained or a separate unit) that is activated when the button 25 is depressed. Button 25/switch 27 can be coupled to transmitter 28 or can be coupled to a processor chip 24 containing preprogrammed transmission information. A battery power source 22 is coupled to the transmitter 28 to provide power when activated by switch 27. The battery 22 is of sufficient strength as to allow several thousand triggering instances without power failure and may be a watch-type battery. For example, one or more batteries of 3–12 volts can be used, depending on the particular features of the ASIC utilized.

Figure 5:
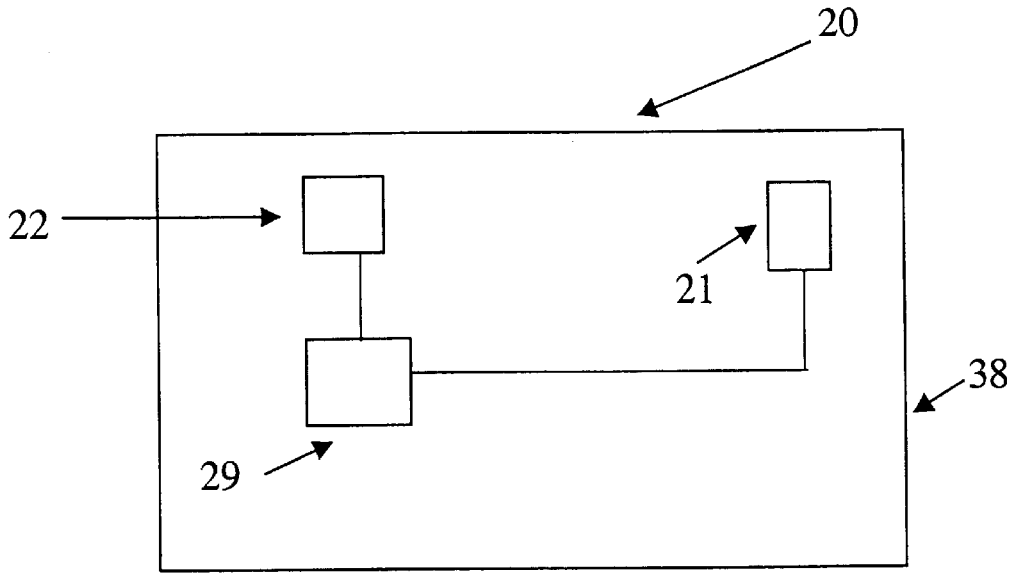
FIG. 5 is a schematic diagram of a sending unit of a remote control locator system according to an alternative aspect of the present invention.

For example, in one embodiment, shown in FIG. 5, sending unit 20 can include a conventional 12 V watch type battery 22 connected to an encoder ASIC 29 to generate an encoded locator signal. Also in this embodiment, a conventional antenna 21 can be used to transmit the locator signal to the receiving unit. Other electrical components (e.g., a crystal oscillator, capacitors, transistors, and the like) can also be included in sending unit 20, depending on the requirements of the particular encoder ASIC used. Alternatively, one or more of these components can be combined in existing conventional components. Further, as would be apparent to one of ordinary skill in the art, the components of sending unit 20 can be configured to minimize the space required and minimize the size of sending unit 20.

A high strength sticker tab or similar adhesive can be mounted on a flat side of the sending unit housing 26 facing opposite the button (and thus not shown). The user can then attach or affix the sending unit 20 to a convenient location. For example, this location can be the consumer electronic device for which the remote locator is used. In use, having a convenient, logical and permanent position for the sending unit 20 provides the user the ability to locate a commonly misplaced remote control device. Alternative mounting arrangements may be used, such as a two-part Velcro type fastener, one part of which is adhered to the module and the other part is adhered to the desired mounting location. Such removable mounting arrangements allow the user to move or carry the sending units to other locations, if necessary.

Figure 3A:
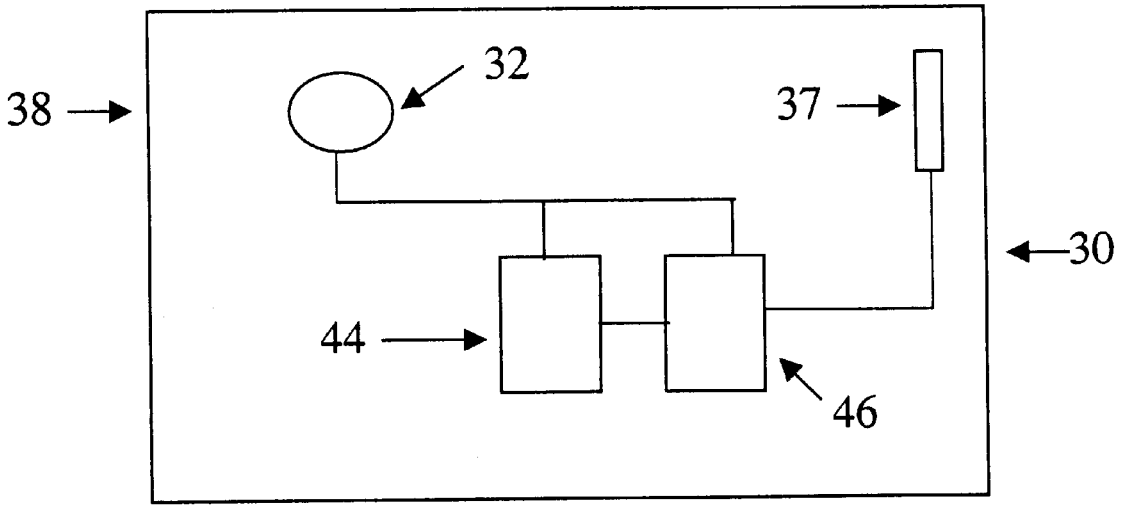
FIG. 3A is a schematic diagram of a receiving unit of a remote control locator system according to a preferred aspect of the present invention.
Figure 3B:
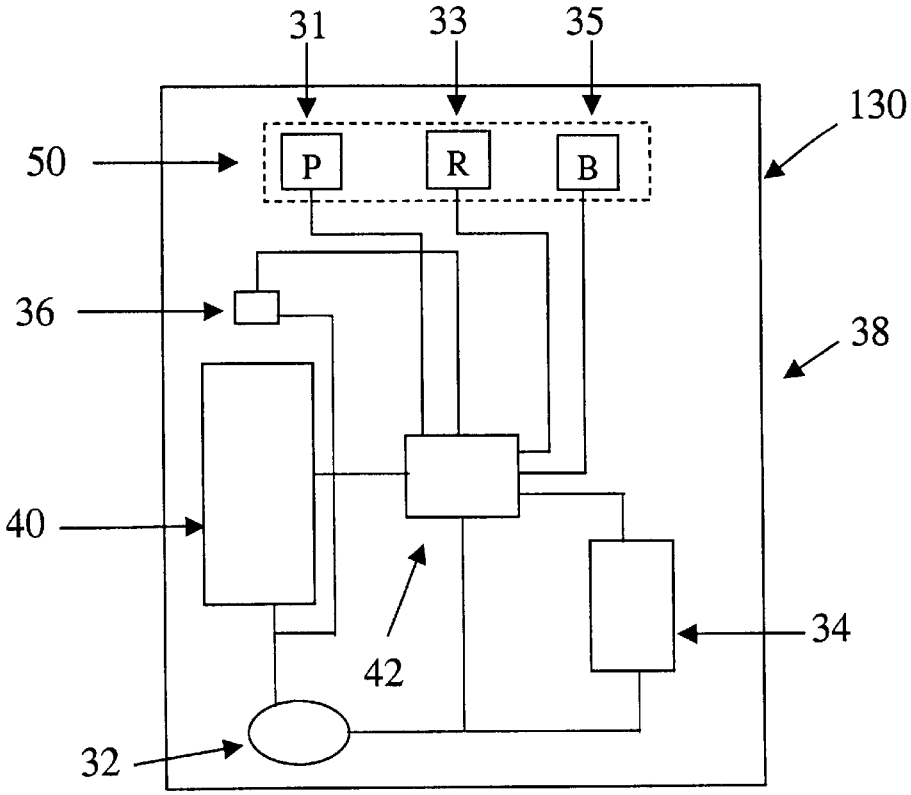
FIG. 3B is a schematic diagram of a receiving unit of a remote control locator system according to another embodiment of the present invention.

Alternative receiving units are shown in FIGS. 3A and 3B For example, a corresponding receiving unit 30, shown in FIG. 3A, comprises a receiver that is housed in a separate housing 38 that can be manufactured from a thin plastic material or the like. The housing 38 can be rectangular or circular in shape, and is preferably thin (e.g., having a thickness of about 8–15 mm). In addition, housing 38 is preferably similar in size and shape with the thin housing 26 of the sending unit 20.

For example, receiving unit 30 can include a battery 32 to provide a power source for a decoder ASIC 46, to decode the locator signal sent by the sending unit 20. Receiving unit 30 can also include a conventional sound integrated circuit (IC) 44 to generate an audible beacon, e.g. a beeping sound. A hole or small vented opening (not shown) can be provided in the housing of the receiving unit to permit the audible beep or tone to be heard. Also in this embodiment, a conventional miniature antenna 37 is used to receive the locator signal transmitted from the sending unit 20. Preferably, the receiver/decoder is selected to match the transmitter/encoder used. For example, a PT2272 decoder-type ASIC from Princeton Technologies can be used in conjunction with the PT2262 encoder-type ASIC. Other encoder/decoder matching arrangements can also be utilized, as would be apparent to one of ordinary skill in the art given the present description. Alternatively, one or more of these components can be combined in existing conventional components. Further, the configuration of the components within receiving unit 30 can be arranged so as to further reduce size.

The sending unit 20 and receiving unit 30 can be pre-programmed when manufactured. In addition, the receiving unit 30 can be activated when the pre-programmed coded frequency is detected from the corresponding sending unit 20, where the receiver 30 is pre-set to the triggering frequency of the sending unit 20.

Figure 3C:
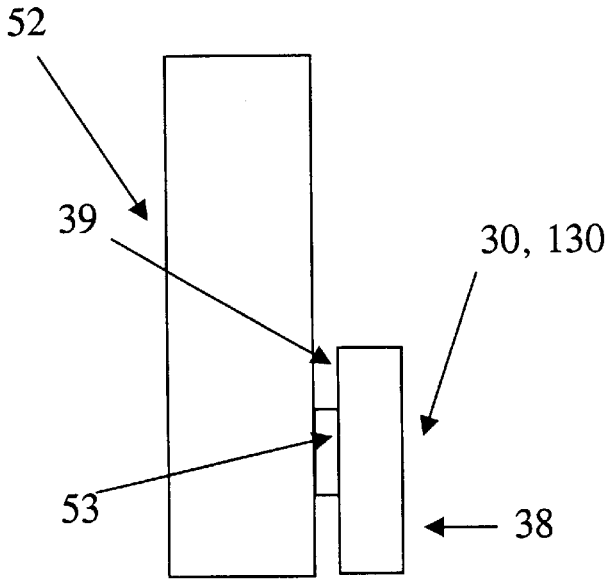
FIG. 3C is a schematic diagram of a receiving unit of a remote control locator system according to another embodiment of the present invention attached to a remote control unit.

As shown in FIG. 3C, the receiver unit 30 also has a mounting element 53, such as a high strength sticker tab or similar adhesive or Velcro-type mount, coupled to the backside 39 of housing 38 so as to allow mounting to a remote control device 52. A removable mounting arrangement allows the user to move the receiving unit to another remote control device or other household or personal item, if necessary. Once units 20 and 30 have been attached to their preferred locations, the user has the ability to trigger a beacon (e.g., a beeper sound, tone, or a recorded message), which enables the user to locate a misplaced remote control device or other household or personal item.

In an alternative embodiment, the sending unit 20 and receiving unit 30 can be activated by a triggering device, such as a battery retaining strip commonly used in conventional consumer packaging, that is temporarily adhered to both units and is pulled out by a user after purchase to allow the battery terminals to then make contact with their respective leads. At that point, the battery life starts. Thus, a sending unit 20 can be pre-programmed with a randomly generated, pre-programmed frequency. When the receiving unit 30 is first activated by the sending unit, the pre-programmed frequency code of the sending unit 20 is embedded in the receiving unit 30 as its triggering signal, thus avoiding the need to pre-program the receiving unit.

An alternative configuration of a receiving unit 130 is shown in FIG. 3B. In this embodiment receiving unit 130 includes a power source 32 similar to that contained within the sending unit. The power source 32 may be implemented as one or more conventional watch-type batteries (e.g., 3–12 V), which provide sufficient strength for several thousand responses without power failure. In addition, the receiving unit 130 further comprises a programming mechanism that allows a user to record a custom sound for the beacon. For example, as shown in FIGS. 1 and 3B, the top of the receiver unit 130 also houses a multi-position switch. In this embodiment, the multi-position switch is a three-position switch 50. The slide mechanism 37 of the three position switch 50 can be enclosed with a sheathing material (not shown) to minimize dust and other particles from entering the opening that surrounds the switch. An indicator knob 49 for the switch 50 is recessed into the slide mechanism 37 to minimize instances of accidental mode change. For example, the indicator knob 49 can have a horizontal groove that can accommodate a very thin tool for assistance with position and beacon mode change. An adult fingernail will usually be a sufficient tool for this use.

Position 35 on the switch is indicated to the user on the outside of the housing and can be denoted by the letter "B." The "B" represents the beeper function of the system. A conventional processor chip 42 enclosed within the housing is connected to the power source 32 and is activated to record when three position switch 50 is in position 35. For example, when configured as such, if the receiving unit 130 is triggered by detection of a signal from the sending unit 20, in the "B" position, a speaker 40 will emit preprogrammed audible beep blast for a predetermined duration of time (e.g., about 10 seconds). The chip 42 is wired through a speaker 40, which is also contained within the housing.

A second position 33 for the three-position switch 50 is indicated to the user and can be denoted by the letter "R" that can be imprinted on the outside of the housing of receiver unit 130. The "R" represents the record mode for the unit. The chip 42 is configured to record sound for a predetermined time duration (e.g., 5–10 seconds) and is connected to a small microphone 36. The recorded message is then stored in the processor chip 42. The microphone 36 is preferably mounted near the speaker 40 so as to allow a single vented access hole to both. Thus, when the sending unit button 25 is depressed and the switch is in the "R" position the user can record a personalized message.

A third position 31 for the switch 50 is indicated to the user and denoted by a letter "P" that can be imprinted on the outside of the housing. This "P" represents the playback mode of the system. The chip 42 is configured within the housing to playback a recorded personalized message through speaker 40 when the indicator knob 49 is placed at position 31.

Figure 4:
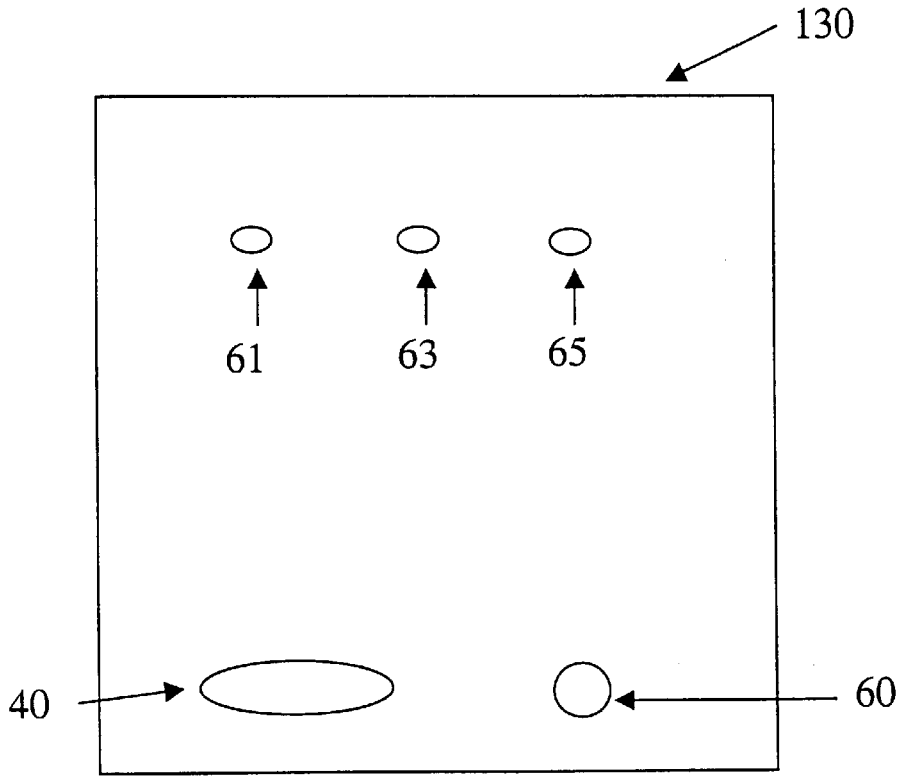
FIG. 4 is a schematic diagram of a receiving unit of a remote control locator system according to another embodiment of the present invention.

Alternatively, instead of using a mechanical slide and position knob, the indications of the playback, record, and beeper modes can be accomplished using separate light indicators, such as light emitting diodes (LEDs). For example, as shown in FIG. 4, three LEDs 61, 63, and 65, can be utilized to indicate the mode in which the receiving unit 130 is configured. In addition, a small button 60 or the like can be utilized to change the mode of the receiving unit when button 60 is depressed, as would be apparent to one of ordinary skill in the art given the present description.

Applications of the present invention are numerous. For example, the locator system of the present invention can be used to find remote control devices such as hand-held remote controls for a television, VCR, cable TV box, or personal satellite system, an electronic key-chain used to remotely open car doors and activate car alarm systems, or other common household items susceptible to being misplaced, such as cellular phones, eyeglass/ sunglass cases, dog collars, moneyclips, and wallets. In addition, the locator system can be used as a novelty item, such as a remotely activated whoopee cushion, a talking dog (when the receiving unit is mounted to a dog collar and is in the play-back mode), a fake doorbell, and the like.

While the invention has been described in detail and with reference to specific embodiments thereof, it will be apparent to one skilled in the art that various changes and modifications can be made therein without departing from the scope of the invention. Thus, the breadth and scope of the present invention should not be limited by any of the above-described exemplary embodiments.

What is claimed is:

1. A remote control locator system to locate a household remote control device, comprising:

a sending unit that includes:

an antenna residing in a sending unit housing, an encoder ASIC to generate a coded locator signal, and an activation mechanism, coupled to said encoder ASIC, to send the locator signal when said activation mechanism is activated by a user;

a receiving unit that includes:

an antenna residing in a receiving unit housing and coupled to a decoder ASIC to receive said locator signal, a sound integrated circuit to emit an audible sound when the receiving unit receives said locator signal; and a first mounting element disposed on a side of the receiving unit housing to couple said receiving unit to the remote control device and a second mounting element disposed on a side of the sending unit, each of the first and second mounting elements selected from the group consisting of a high strength adhesive and a Velcro-type fastener.

2. A remote control locator system to locate a household remote control device, comprising:

a sending unit that includes:

a transmitter residing in a sending unit housing, and an activation mechanism coupled to said transmitter to send a locator signal when said activation mechanism is activated by a user; and a receiving unit that includes a receiver residing in a receiving unit housing to receive said locator signal and to emit an audible sound when said receiver receives said locator signal; and a mounting element, disposed on a side of the receiving unit housing to couple said receiving unit to the remote control device, said mounting element selected from the group consisting of a high strength adhesive and a Velcro-type fastener.

3. The remote control locator system according to claim 2, wherein said receiving unit further comprises:

a multi-position switch located in the receiver unit housing and coupled to a processor chip located in the receiving unit housing, wherein when said multi-position switch is placed in a first position, said receiving unit emits a preprogrammed audible sound when said receiver receives said locator signal, and wherein when said multi-position switch is placed in a second position, said receiving unit emits an audible sound corresponding to a personalized message recorded by a user when said receiver receives said locator signal.

4. The remote control locator system according to claim 3, wherein said receiving unit further comprises:

a microphone coupled to said processor chip, wherein when said multi-position switch is placed in a third position, a user can record said personalized message which is stored in said processor chip.

5. The remote control locator system according to claim 2, wherein said mounting element consists of a high strength adhesive mounted on a side of the receiving unit housing such that it can be affixed to the remote control device.

6. The remote control locator system according to claim 2, wherein said sending unit further comprises a mounting element disposed on a side of the sending unit housing, said mounting element selected from the group consisting of a high strength adhesive and a Velcro-type fastener.

7. The remote control locator system according to claim 4, wherein said receiving unit further comprises a sliding mechanism and an indicator knob configured such that said indicator knob can be placed into positions along said sliding mechanism corresponding to said first, second, and third positions.

8. The remote control locator system according to claim 2, wherein said sending unit further comprises a power source coupled to the transmitter such that said transmitter is power e d when said activation mechanism is activated.

9. The remote control locator system according to claim 2, wherein said receiving unit further comprises a power source coupled to the processor chip and the receiver.

10. The remote control locator system according to claim 4, wherein said receiving unit further comprises an indicator unit that includes three light emitting diodes, each of which corresponds to said first, second, and third positions, and an activation button coupled to said multi-position switch such that operational modes of said receiver unit can be altered by depressing said activation button.

11. The remote control locator system according to claim 2, wherein the locator signal is a low, high, ultra high, or radio frequency signal.

12. The remote control locator system according to claim 2, wherein the sending unit comprises:

an antenna residing in a sending unit housing; and an encoder ASIC to generate a coded locator signal.

13. The remote control locator system according to claim 12, wherein the receiving unit comprises:

a decoder ASIC matched with the encoder ASIC to receive the coded locator signal; and a sound integrated circuit to emit an audible sound when the receiving unit receives the coded locator signal.

14. A remote control communicator, comprising:

a receiver housing;

a receiver to receive a locator signal residing in said receiver housing;

a speaker to emit an audible sound when said receiver receives said locator signal; and a multi-position switch located in the receiver housing and coupled to a processor chip located in the receiver unit housing, wherein when said multi-position switch is placed in a first position, said speaker emits a preprogrammed audible sound when said receiver receives said locator signal, and wherein when said multi-position switch is placed in a second position, said speaker emits an audible sound corresponding to a personalized message recorded by a user when said receiver receives said locator signal.

15. The remote control communicator according to claim 14, further comprising:

a microphone coupled to said processor chip, wherein when said multi-position switch is placed in a third position, a user can record said personalized message which is stored in said processor chip.

16. The remote control communicator according to claim 15, further comprising:

an indicator to indicate the position of said multi-position switch.

17. The remote control communicator according to claim 16, wherein said indicator comprises a sliding mechanism and an indicator knob configured such that said indicator knob can be placed into positions along said sliding mechanism corresponding to said first, second, and third positions.

18. The remote control communicator according to claim 16, further comprising:

a mounting element disposed on a side of the receiver housing opposite said indicator such that said receiver is affixable to a remote control device.

* * * * *